US006685536B1

(12) United States Patent
Junker

(10) Patent No.: US 6,685,536 B1
(45) Date of Patent: Feb. 3, 2004

(54) METHOD FOR GRINDING CONVEX RUNNING FACES AND OUTSIDE DIAMETERS ON SHAFT-LIKE WORKPIECES IN ONE SET-UP AND GRINDING MACHINE FOR CARRYING OUT THE METHOD

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 10/009,880

(22) PCT Filed: Apr. 27, 2000

(86) PCT No.: PCT/EP00/03837

§ 371 (c)(1),
(2), (4) Date: Jan. 7, 2002

(87) PCT Pub. No.: WO00/67947

PCT Pub. Date: Nov. 16, 2000

(30) Foreign Application Priority Data

May 11, 1999 (DE) ..... 199 21 785

(51) Int. Cl.[7] ..... B24B 49/00

(52) U.S. Cl. ..... 451/5; 451/24; 451/49; 451/57; 451/65; 451/221; 451/228; 451/233; 451/362

(58) Field of Search ..... 451/5, 24, 49, 451/57, 65, 221, 228, 233, 246, 362

(56) References Cited

U.S. PATENT DOCUMENTS

| | | | | | |
|---|---|---|---|---|---|
| 3,728,823 | A | * | 4/1973 | Tomita et al. | 451/222 |
| 3,783,718 | A | * | 1/1974 | Kuhne et al. | 82/117 |
| 4,136,489 | A | * | 1/1979 | von Allmen | 451/231 |
| 4,461,121 | A | * | 7/1984 | Motzer et al. | 451/5 |
| 4,617,764 | A | * | 10/1986 | Reibakh | 451/5 |
| 4,754,574 | A | * | 7/1988 | Clough et al. | 451/246 |
| 4,897,964 | A | * | 2/1990 | Vetter | 451/72 |
| 6,200,200 | B1 | * | 3/2001 | Himmelsbach | 451/62 |

FOREIGN PATENT DOCUMENTS

| | | |
|---|---|---|
| DE | 1068144 | 10/1956 |
| DE | 2333041 | 1/1975 |
| EP | 0457016 | 11/1991 |
| WO | WO9932258 | 7/1999 |
| WO | WO0009290 | 2/2000 |

* cited by examiner

*Primary Examiner*—M. Rachuba
(74) *Attorney, Agent, or Firm*—Jordan and Hamburg LLP

(57) ABSTRACT

The invention relates to a method for grinding convex running surfaces and exact outside diameters on undulated workpieces. In a clamping, a first convex running surface is ground on a discoid partial section of an undulated workpiece during a first grinding operation while using a first grinding wheel that comprises at least one concave lateral surface. A second grinding wheel is used to grind a desired outside diameter on the discoid partial section as well as on other partial sections of the undulated workpiece during a second grinding operation.

11 Claims, 5 Drawing Sheets

METHOD FOR GRINDING CONVEX RUNNING FACES AND OUTSIDE DIAMETERS ON SHAFT-LIKE WORKPIECES IN ONE SET-UP AND GRINDING MACHINE FOR CARRYING OUT THE METHOD

The invention relates to a method of grinding convex running faces and outside diameters on shaft-like workpieces in one set-up and a grinding machine for carrying out the method.

According to the prior art, the grinding of convex running faces and outside diameters on shaft-like workpieces is effected by means of angular plunge grinding machines, in which case the machining of the corresponding shaft parts has to be effected in a plurality of set-ups. This procedure is therefore based on a plurality of operations, since the shaft parts to be machined have to be ground repeatedly on various grinding machines. This involves repeated setting-up with further production disadvantages, for even the smallest dimensional and geometrical inaccuracies are transferred in a cumulative manner to the finished part from one set-up to the other set-up.

Against this background, the object of the invention is to provide a method of grinding convex running faces and outside diameters on shaft-like workpieces in one set-up. In particular, semielliptical or parabolic running faces are to be ground. Furthermore, a special machine, with which the disadvantages associated with the prior art are removed, is to be used for this purpose. In this case, the shaft parts to be machined are to be ground in one set-up with two CBN grinding wheels until the finished product is obtained. The method according to the invention is also to permit individual grinding operations on comparable workpieces by means of the special grinding machine.

This object is achieved by a method having the features as claimed in claim 1 and by a grinding machine as claimed in claim 6. The subclaims referring back thereto in each case develop the method technologically and the grinding machine in terms of design.

The method of grinding shaft parts having convex, in particular semielliptical or parabolic, running faces and desired, exact outside diameters on shaft-like workpieces is effected in one set-up on a pivotable grinding headstock. The grinding headstock comprises two arms which form an angle $\alpha$, which is in particular 60°, and at whose free ends grinding spindles are provided. A grinding wheel having at least one concave side face for producing a contour-conforming convex running face on the shaft part to be machined is mounted on the one grinding spindle, and a grinding wheel for producing exact outside diameters on the shaft parts to be machined is mounted on the other grinding spindle. The grinding of a shaft-like workpiece is effected in such a way that the workpiece, which has a plane-side section having a large diameter, is clamped between the centers of a work headstock and a tailstock and is supported with steadyrests at the bearing points of the workpiece.

To produce a running face which is convex, in particular semielliptical or parabolic, in cross section on the plane-side section of the shaft-like workpiece having a large diameter, a relatively large grinding wheel is used, and this grinding wheel, in cross section, has at least one concave, in particular semielliptical or parabolic, side face conforming to the contour of the running face, to be produced, of the shaft-like workpiece section.

According to one embodiment, the opposite side face of the grinding wheel is also of corresponding design if convex running faces are to be produced on both sides of the shaft-like workpiece section having a large diameter.

After the production of the convex running face or convex running faces, the grinding wheel of concave design in cross section is removed from the engagement region with the shaft-like workpiece section by pivoting the grinding headstock. At the same time, the second grinding wheel is set against the outer periphery of the shaft-like workpiece section by traversing the grinding headstock in the X-axis in order to grind an exact diameter.

If this shaft-like workpiece section having a large diameter is to be ground convexly, in particular semielliptically or parabolicly, on both sides, a grinding wheel having two concave, in particular semielliptical or parabolic, side faces which conform to the contour of the running faces, to be produced, of the shaft-like workpiece section having a large diameter is used from the beginning. In this case, after the production of the first convex running face of the shaft-like workpiece section having the large diameter, the grinding wheel is first of all moved on the X-axis out of the region of the shaft-like workpiece section having the large diameter and is pivoted against the previous pivoting direction of the grinding headstock. The workpiece is then moved by a feed movement on the Z-axis in the direction of the workpiece center axis in order to permit the infeed of the grinding wheel for producing the second convex, in particular semielliptical or parabolic, running face of the shaft-like workpiece section with regard to the X-axis. In the process, the second concave, in particular semielliptical or parabolic, side face of the first grinding wheel is brought into engagement with the other side face of the shaft-like workpiece section having the large diameter in order to produce the second convex running face there, which conforms to the contour of the second concave side face of the grinding wheel.

After the grinding of the one convex, in particular semielliptical or parabolic, running face and/or the grinding of the second opposite convex, in particular semielliptical or parabolic, running face of the shaft-like workpiece section having the large diameter, the grinding headstock is moved on the X-axis out of the region of the shaft-like workpiece section having the large diameter. A second grinding wheel, which is mounted on the grinding spindle of the other arm of the work headstock and forms an angle $\alpha$, which is preferably 60°, with regard to the arm having the spindle for the first grinding wheel, is fed in perpendicularly to the longitudinal axis of the shaft-like workpiece in order to produce the desired outside diameters on the corresponding sections of the shaft-like workpiece.

Suitable for carrying out the method is a special machine on whose machine bed a work headstock and a tailstock arranged in alignment in the longitudinal axis are arranged, the work headstock and the tailstock realizing the feed movement in accordance with the Z-axis. Furthermore, steadyrests which can be set against the bearing points of the workpiece are provided in this region of the machine bed. A two-armed grinding headstock is provided behind the arrangement of the work headstock and tailstock, each arm being equipped at the end with a grinding spindle for accommodating grinding wheels. The perpendiculars to the longitudinal axes of the two grinding spindles intersect in a plane at an angle $\alpha$ of preferably 60° at the pivot axis of the two-armed common grinding headstock having the two grinding spindles arranged thereon at the end and carrying the grinding wheel. The grinding headstock is pivotable in a plane, preferably horizontally, and can be fed in along the X-axis vertically to the Z-axis.

This grinding machine permits the setting of optimum positions of use for the grinding wheels with regard to the workpiece to be machined. The arrangement of the two-armed grinding headstock having the grinding spindles attached in each case at the end for the first and second grinding wheels has the advantage that both grinding spindles are arranged on a common guide for performing the infeed movement in accordance with the X-axis. This arrangement ensures very high rigidity values, including the grinding carriage guide. The high rigidity of the grinding headstock and of the guide system on the guide carriage, due to the grinding in one set-up, produce high accuracy values on the end product produced by grinding. By contrast, the dimensional inaccuracies creeping in during a plurality of set-ups up to the production of the end product accumulate. The high rigidity values of the guide system therefore decisively improve the process reliability of the method and also bring about a reduction in the wear of the grinding wheels.

The method and the grinding machine are explained in more detail in the drawings according to FIGS. 1 to 5.

FIG. 1 shows the design of the grinding machine used for carrying out the method, this grinding machine being arranged on a machine bed and having, in an aligned arrangement, a work headstock and a tailstock, with a shaft-like workpiece which is clamped in between and has a section having the larger diameter, and comprising a two-armed grinding headstock which is arranged behind said work headstock and tailstock and has in each case a grinding spindle mounted at the end in the arms.

Figure 1:
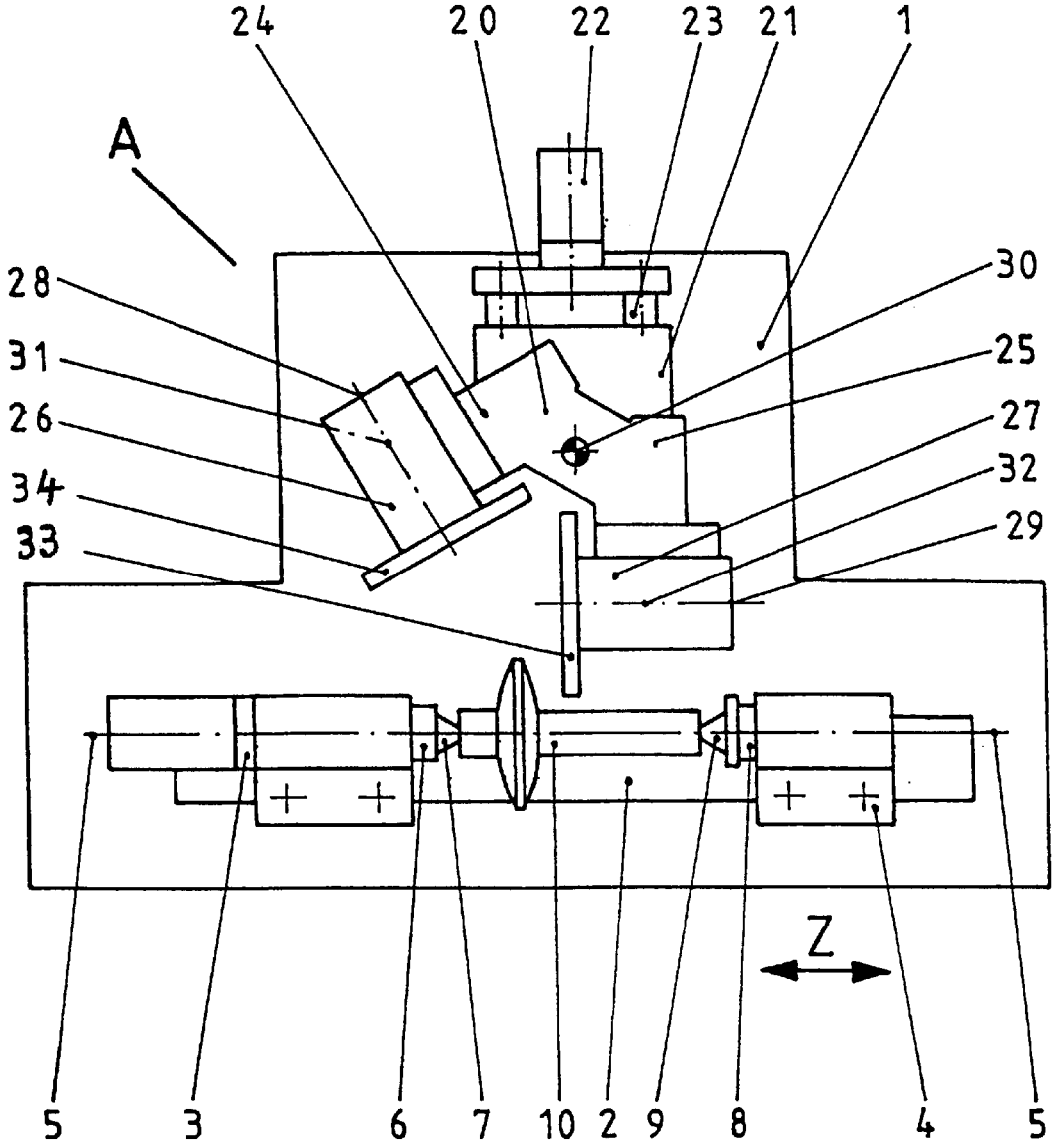

FIG. 1 shows the grinding machine A, to be used according to the method according to the invention, for grinding workpieces such as shaft-like transmission parts. A grinding table 2, on which the feed movement is performed according to the Z-axis along the double arrow, is schematically arranged on the machine bed 1 in the front region. The CNC drive required for this is not shown. On the grinding table 2, a motor-driven work headstock 3 and a tailstock 4 are arranged in alignment on a common longitudinal axis 5. The shaft-like workpiece 10 to be finish ground, which has a section having a large diameter D, is clamped between the work headstock 3 and the tailstock 4. For this purpose, the work headstock 3 has a rotationally driven work spindle 6 which in the front region has a work holder 7 designed as a center. The opposite tailstock 4 arranged in alignment on the grinding table 2 has a hydraulically axially displaceable tailstock quill 8. This tailstock quill 8 has a tailstock center 9 at the end on the workpiece side. The longitudinal axis of the work spindle 6 of the work headstock 3, the longitudinal axis of the workpiece 10 and the longitudinal axis of the tailstock quill 8 of the tailstock 4 therefore form a common, aligned longitudinal axis 5.

Arranged in the rear region of the machine bed 1 is a grinding headstock 20, which is mounted on a guide carriage 21. The guide carriage 21 is equipped with an infeed drive 22, which realizes the infeed movement in the X-axis relative to the workpiece 10. The guide carriage 21 is hydrostatically mounted on guides 23 and is oriented at right angles to the workpiece center axis 5. The guide carriage 21 is consequently arranged so as to be displaceable in accordance with the CNC axis. The grinding headstock 20 comprises two arms 24 and 25 which in each case have, at the end, grinding spindles 28 and 29 equipped with HF drives 26 and 27. The verticals starting in a plane from the longitudinal axes 31 and 32 of the grinding spindles 28 and 29, while forming an angle $\alpha$, for example an angle $\alpha$ of 60°, intersect at the pivot axis 30 of the two arms 24 20 and 25 of the grinding headstock 20. The grinding headstock 20 can be pivoted in an infinitely variable manner about the angle $\alpha$ in accordance with the CNC axis to such an extent that, depending on the preselection, the one or the other longitudinal axis 31 25 or 32 of the grinding spindle 28 or 29 assumes a position parallel to the longitudinal axis 5 of the workpiece 10. Each grinding spindle 28, 29 is equipped with a grinding wheel 33, 34.

Figure 2:
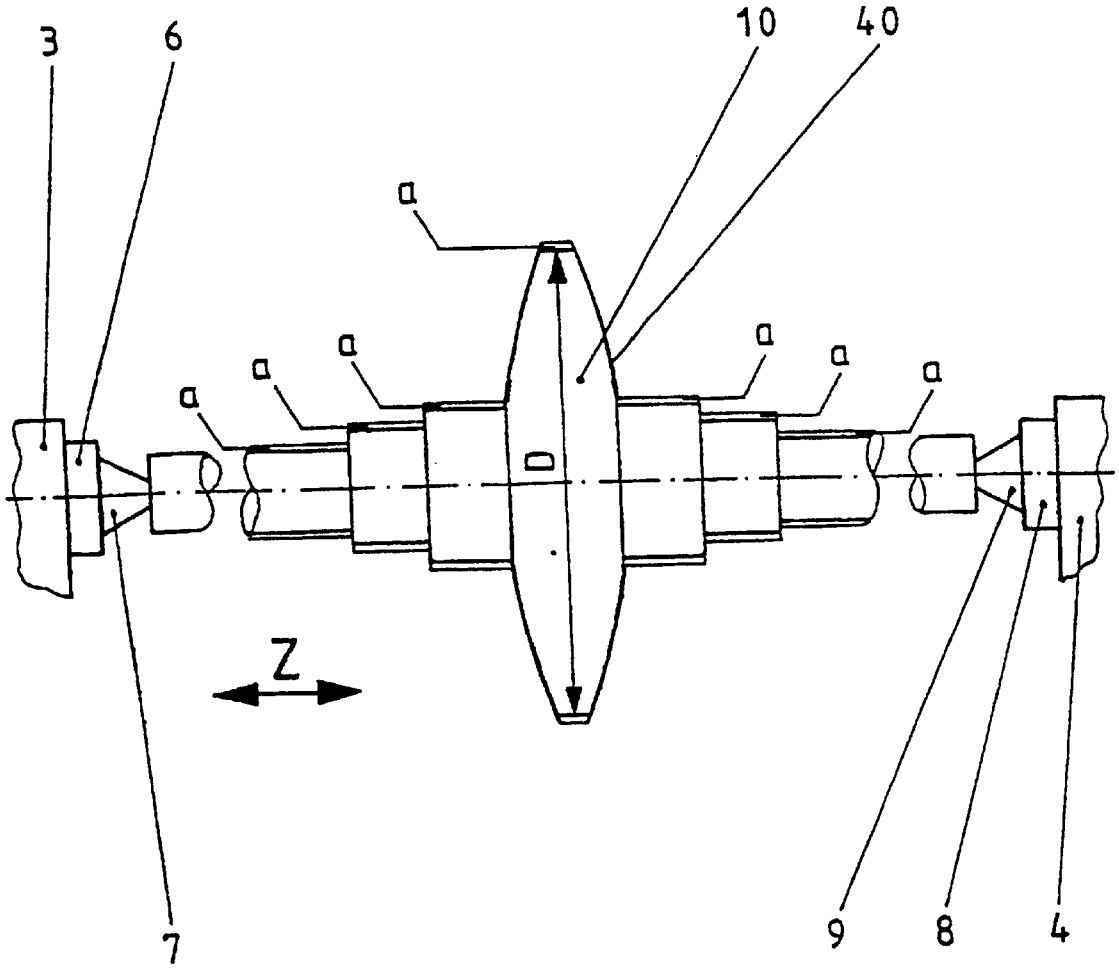
FIG. 2 shows the clamping of a shaft-like workpiece, pre-ground with an allowance, between the centers of the work headstock and the tailstock with the Z-axis characterizing the feed movement, the workpiece having a disk-shaped section with a large diameter.

Shown in FIG. 2 is the clamping of a shaft-like 30 workpiece 10 which is pre-ground with an allowance a and has a section 40 having a large diameter. The allowance is, for example, between 0.1 and 0.2 mm. The workpiece 10 is clamped between the center of the work holder 7 of the work spindle 6 of the work headstock 3 and the tailstock center 9 of the tailstock quill 8 of the tailstock 4. The positioning (not shown in FIG. 2) of the grinding wheels 33 and 34 and of the grinding spindles 28 and 29 can correspond to the position according to FIG. 1.

Figure 3:
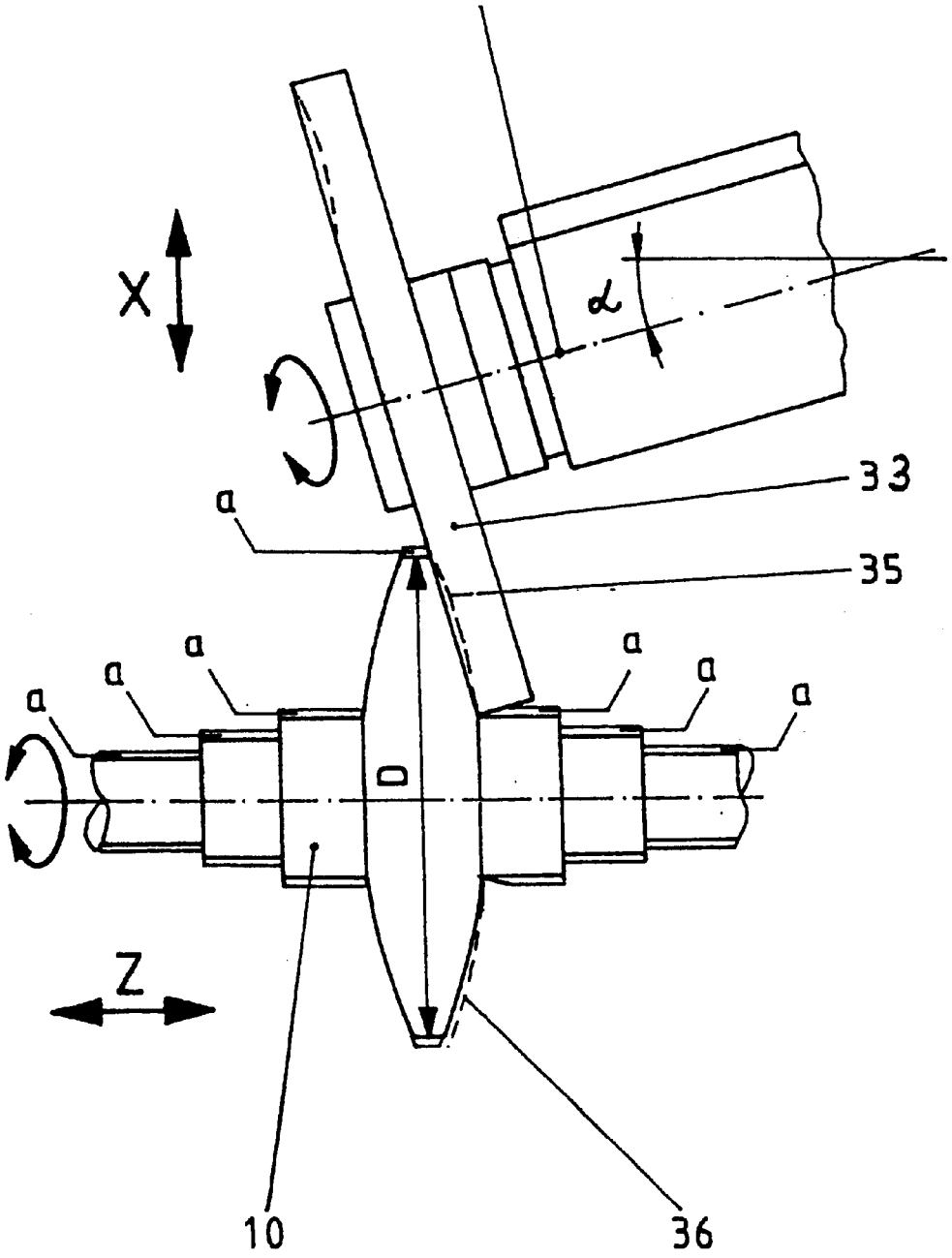
FIG. 3 shows the first method step for grinding a first convex, in particular conical, semielliptical or parabolic, running face on the disk-shaped section of the shaft-like workpiece having the larger diameter by means of a concave, in particular semielliptical or parabolic side face, conforming to the contour, of a first grinding wheel.

Shown in FIG. 3 is the positioning of the first grinding wheel 33 and of the shaft-like workpiece 10 in a first method step, in which the longitudinal axis 32 of the grinding spindle 29 is inclined by an angle $\alpha$ relative to the horizontal This angle $\alpha$ corresponds to the convex, in particular conical, semielliptic or parabolic, running face 36 of the workpiece 10 which can be achieved with the first grinding wheel 33, which has a side face 35 of concave, in particular semielliptic or parabolic, design, the running face 35 conforming to the contour of the side face 35 of concave design. In the process, the infeed of the first grinding wheel 33 follows the X-axis, whereas the feed movement is performed via: the Z-axis by means of the guide carriage 21.

Figure 4:
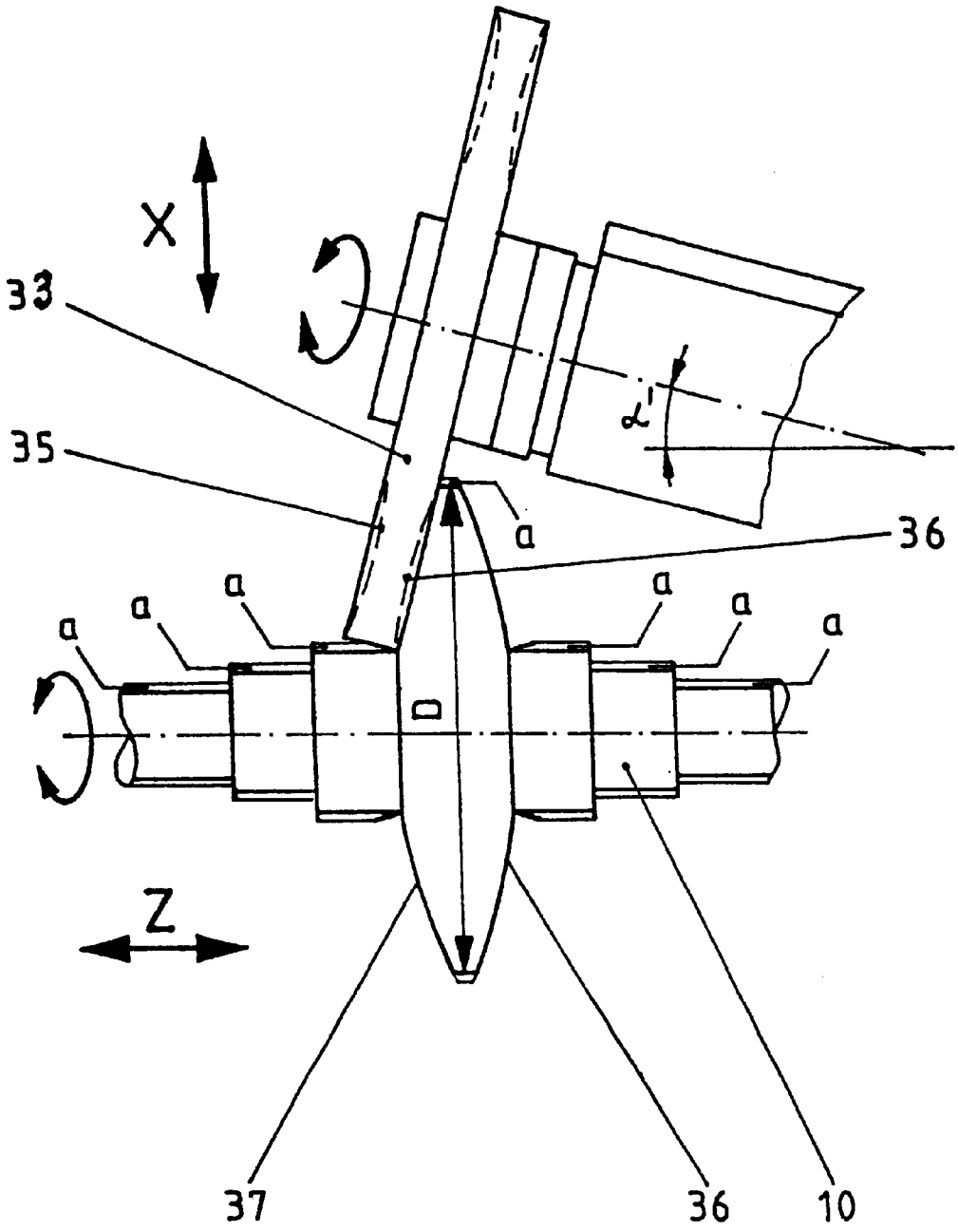
FIG. 4 shows the second method step for grinding a convex, in particular semielliptical or parabolic, running face on both sides on the disk-shaped section of the shaft-like workpiece having the large diameter by means of a second concave, in particular semielliptical or parabolic, side face, conforming to the contour, of the first grinding wheel.

The grinding of convex, in particular semielliptical or parabolic, running faces 36 and 37 on both sides on the section of the workpiece 10 having the large diameter D is shown in FIG. 4. For this purpose, the first grinding wheel 33, which has two concave side faces 35 and 35', in particular of semielliptical or parabolic design, is pivoted 25 in the opposite direction by the angle $\alpha'$, in the course of which, by appropriate infeed movement along the X-axis and feed movement along the Z-axis, the grinding wheel 33 is brought into use with the side face 35' for producing the second convex, in particular semielliptical or parabolic, running face 37 on the section having the large diameter D.

Figure 5:
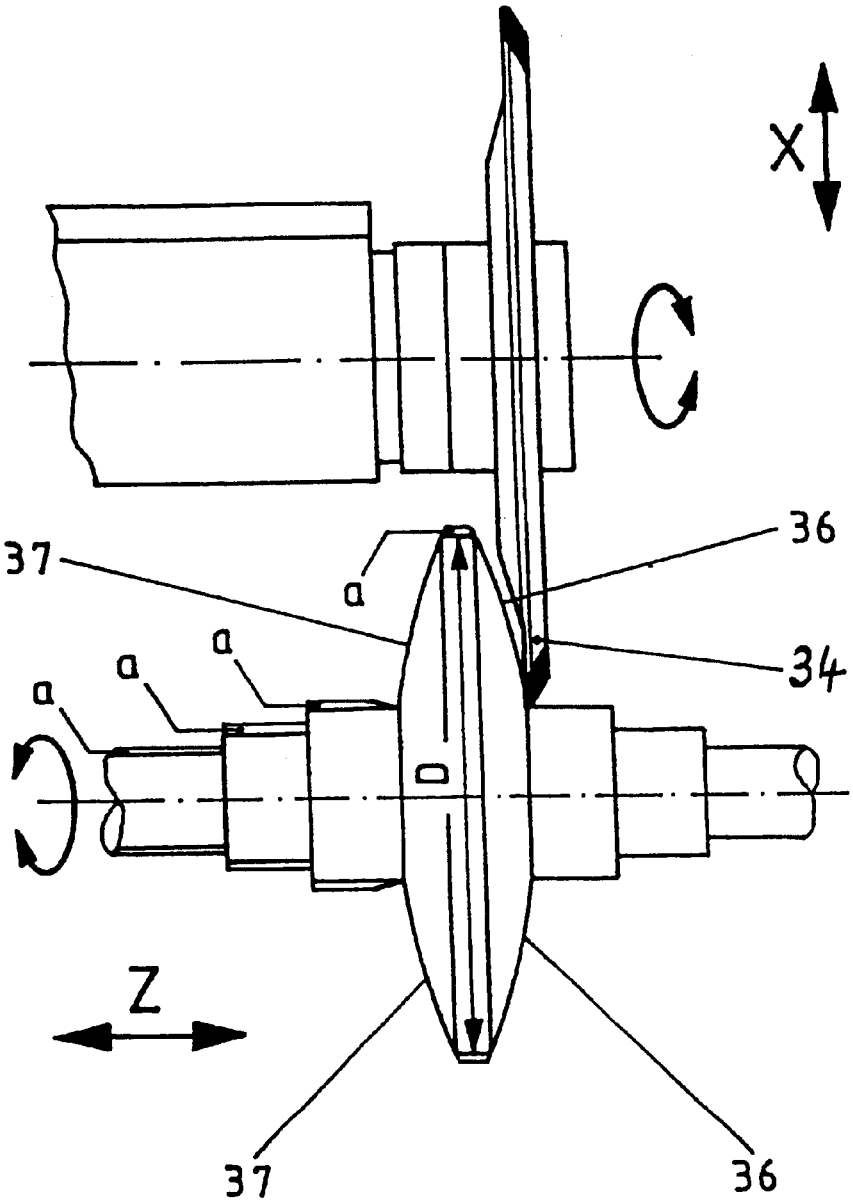
FIG. 5 shows the third method step for producing different outside diameters on a shaft-like workpiece.

Finally, FIG. 5 shows the grinding of exact outside diameters by grinding the allowance a down to the individual cylindrical sections of the shaft-like workpiece 10 by means of the second grinding wheel 34, the longitudinal axis 21 of the associated grinding spindle 28 being positioned by pivoting the grinding headstock 20 about the pivot axis 30 parallel to the longitudinal axis 5 of the workpiece 10, and the infeed and feed movements being effected in accordance with the X-axis and the Z-axis.

According to the method according to the invention, with the special grinding machine, which is equipped with a pivotable grinding headstock 20, the repeated setting-up of shaft-like workpieces for the purpose of producing exact convex, semielliptical or parabolic running faces and exact outside diameters is eliminated. At the same time, according to the method according to the invention and the special grinding machine A, finished parts are produced with high dimensional and geometrical accuracy, since an accumulation of inaccuracies related to the setting-up is ruled out.

Considerable operational advantages due to the saving of resetting times and the like are associated with the grinding and production advance achieved, i.e. the production of two convex side faces on a disk-shaped shaft section having a large diameter and exact outside diameters on the shaft-like workpiece, for example a transmission shaft. At the same time, the finish-ground workpieces are characterized by maximum measuring accuracy.

What is claimed is:

1. A method of grinding outside diameters and other surfaces on a workpiece which may be carried out in one set-up, the workpiece having elongated dimension and including a relatively larger diameter section, the method comprising:

grinding a convex running face on the relatively larger diameter section of the workpiece with a first grinding wheel having at least one concave side face; and grinding a desired outside diameter on the relatively larger diameter section of the workpiece and other sections of the workpiece with a second grinding wheel.

2. The method as claimed in claim 1, wherein:

the first grinding wheel has first and second concave side faces;

said step of grinding a convex running face includes grinding a first convex running face on the relatively larger diameter section of the workpiece with said first concave side face and grinding a second convex running face on the relatively larger diameter section of the workpiece with said second concave side face; and the second grinding operation is finish-grinding.

3. The method as claimed in claim 1, wherein the second grinding wheel has at least one of a sharp encircling edge and a plane lateral surface.

4. The method as claimed in claim 1, 2 or 3, wherein the first grinding wheel and the second grinding wheel are pivoted about an angle $\alpha$ and thereby sequentially brought into engagement with portions of the workpiece which are to be ground.

5. The method as claimed in claim 4, wherein the angle $\alpha$ is about 60°.

6. A grinding machine, comprising:

a machine bed having a grinding table in a front region of the machine bed, the grinding table being adapted for a feed movement of a workpiece along a Z-axis;

a rotationally driven work headstock and a tailstock arranged in alignment on the grinding table on a common longitudinal axis, the work headstock having a rotationally driven work spindle which is provided in a front region thereof with a work holder comprising a center, the tailstock having a tailstock spindle which is provided with a tailstock center at an end on the workpiece side; and a grinding headstock arranged in a rear region of the machine bed and being mounted on a guide carriage, the guide carriage being equipped with an infeed drive which effects an infeed movement in an X-axis relative to the workpiece, the guide carriage being hydrostatically mounted on guides and being oriented at right angles to a longitudinal axis of the workpiece, the grinding headstock comprising two arms which in each case have, at an end thereof, grinding spindles whose verticals starting in a plane from their longitudinal axes intersect at an angle $\alpha$ at a pivot axis of the two arms, and said grinding spindles having a first and second grinding wheel, respectively, the first grinding wheel having at least one concave side face contactable with a section of the workpiece for grinding a convex running face thereon, steadyrests being provided for suppoting the workpiece, and the tailstock spindle being hydraulically axially displaceable.

7. The grinding machine as claimed in claim 6, wherein the angle $\alpha$ is about 60°.

8. The grinding machine as claimed in claim 6 or 7, wherein each of said grinding spindles is rotationally driven and each of said grinding wheels is at a free end of a respective one of the arms.

9. The grinding machine as claimed in claim 6 or 7, wherein each of the grinding spindles has a respective HF drive.

10. The grinding machine as claimed in claim 6 or 7, wherein the grinding headstock is infinitely variably pivotable about said pivot axis.

11. A method of grinding outside diameters and other surfaces on a workpiece which is of elongated dimension and includes at least one disk-shaped section of relatively larger diameter than a remainder of the workpiece, the method comprising:

grinding a convex running face on the disk-shaped section of the workpiece by contact there with a concave side face of a first grinding wheel, the concave side face being arranged orthogonally to a rotational axis of the first grinding wheel; and grinding a desired outside diameter on the disk-shaped section and other sections of the workpiece with a second grinding wheel.

* * * * *